US012114722B2

(12) United States Patent
McCarthy

(10) Patent No.: US 12,114,722 B2
(45) Date of Patent: Oct. 15, 2024

(54) HAT HEADLINER HAVING TEMPERATURE CONTROL MEMBERS

(71) Applicant: Simon McCarthy, Kelowna (CA)

(72) Inventor: Simon McCarthy, Kelowna (CA)

( * ) Notice: Subject to any disclaimer, the term of this patent is extended or adjusted under 35 U.S.C. 154(b) by 67 days.

(21) Appl. No.: 18/048,989

(22) Filed: Oct. 24, 2022

(65) Prior Publication Data

US 2024/0130455 A1 Apr. 25, 2024
US 2024/0225164 A9 Jul. 11, 2024

(51) Int. Cl.
*A42B 1/008* (2021.01)

(52) U.S. Cl.
CPC ..... *A42B 1/008* (2013.01)

(58) Field of Classification Search
CPC ..... A42B 1/008; A42B 3/285; A42B 1/241; A42B 1/0189; A42B 3/10; A42B 3/121; A42C 5/02; A41D 20/005; A41D 13/0053; A41D 13/0058; A41D 20/00; A41D 2023/002
See application file for complete search history.

(56) References Cited

U.S. PATENT DOCUMENTS 4,204,543 A * 5/1980 Henderson ..... A41D 13/0055 2/171.2
4,776,042 A * 10/1988 Hanson ..... A42B 1/008 2/909
4,805,619 A * 2/1989 Swearingen ..... A61F 7/103 607/109
4,815,144 A * 3/1989 Martin ..... A42C 5/04 2/171.2
5,054,122 A * 10/1991 Sher ..... A42B 1/008 2/181.6
5,305,470 A * 4/1994 McKay ..... A41D 20/005 2/171.2
5,557,807 A * 9/1996 Hujar ..... A42B 1/0187 2/209.13
5,887,284 A * 3/1999 Simmons ..... A42C 5/02 2/184
5,915,534 A * 6/1999 May ..... A42C 5/02 2/DIG. 11
6,681,590 B1 * 1/2004 Jones ..... A42B 3/285 62/530
6,857,134 B1 * 2/2005 Cowell ..... A42C 5/04 2/209.13

(Continued)

*Primary Examiner* — Robert H Muromoto, Jr.
(74) *Attorney, Agent, or Firm* — Orin Del Vecchio

(57) ABSTRACT

A hat headliner with temperature control members that is configured to provide a temperature dissimilar to that of its environment at locations along a lower edge of a hat. The present invention includes a body that is either permanently or releasably secured into the head cavity of a hat. The body of the present invention includes a perimeter band member wherein the perimeter band member has formed therein a plurality of receptacles. The plurality of receptacles have an interior volume wherein the interior volume is configured to receive and store temperature members. The temperature members include a housing from a malleable material having a temperature controlling gel therein. The receptacles have a first side and a second side wherein the first side of the receptacle is manufactured from a thermally conductive material and is adjacent a wearer's head.

10 Claims, 2 Drawing Sheets

(56) References Cited

U.S. PATENT DOCUMENTS 8,112,821 B1 * 2/2012 Barry ..... A42C 5/02 2/181
8,117,677 B2 * 2/2012 Toth ..... A42B 3/121 2/413
8,166,772 B2 * 5/2012 Cho ..... A42B 1/008 62/259.3
8,658,943 B1 * 2/2014 Larsen ..... A61F 7/02 607/108
9,241,522 B2 * 1/2016 Branson ..... A41D 23/00
9,615,620 B2 * 4/2017 Miranda ..... A42C 5/02
11,112,181 B2 * 9/2021 McNeal-Burgess ..... A61F 7/02
11,266,193 B2 * 3/2022 Bowman ..... A42B 1/04
2004/0054342 A1 * 3/2004 Newbill ..... A61F 13/15658 604/368
2004/0244412 A1 * 12/2004 Trinh ..... F25D 3/08 62/457.2
2005/0118383 A1 * 6/2005 Cargill ..... A61F 7/02 428/36.1
2005/0268382 A1 * 12/2005 Epling ..... A42B 1/0189 2/411
2006/0005291 A1 * 1/2006 Bedford ..... A42B 3/285 2/171.2
2008/0040831 A1 * 2/2008 Nilforushan ..... A61F 7/02 219/211
2008/0058747 A1 * 3/2008 Singh Kainth ..... A61L 15/26 604/372
2011/0072555 A1 * 3/2011 Asiatico ..... A42C 5/02 2/181.4
2011/0296579 A1 * 12/2011 Galvan ..... A41B 3/18 2/60
2013/0152274 A1 * 6/2013 Welch ..... A42B 1/008 2/171.2
2013/0247281 A1 * 9/2013 Zebouni ..... A42C 5/02 2/272
2013/0296986 A1 * 11/2013 Dukes ..... A61F 7/10 607/108
2014/0303699 A1 * 10/2014 Wahl ..... A61F 7/02 607/110
2015/0092972 A1 * 4/2015 Lai ..... H04R 1/1083 381/333
2016/0058084 A1 * 3/2016 Stevenson ..... A41D 20/005 2/209.13
2016/0219965 A1 * 8/2016 Sansone ..... A42B 3/285
2016/0316848 A1 * 11/2016 Miranda ..... A42C 5/02
2017/0224530 A1 * 8/2017 Farrago ..... A61F 7/02
2018/0303182 A1 * 10/2018 Smith ..... A42C 5/04
2019/0307604 A1 * 10/2019 Ainslie ..... C25B 1/22
2020/0229526 A1 * 7/2020 Santos ..... A42B 1/241
2021/0337907 A1 * 11/2021 Bowman ..... A42B 1/04
2022/0015941 A1 * 1/2022 Lamb ..... A61F 7/10

* cited by examiner

HAT HEADLINER HAVING TEMPERATURE CONTROL MEMBERS

FIELD OF THE INVENTION

The present invention relates generally to headwear, more specifically but not by way of limitation, a hat headliner that is configured with a plurality of receptacles along a perimeter edge thereof wherein the receptacles have releasably secured therein temperature members that are configured to provide a temperature that is dissimilar to that of the environment.

BACKGROUND

As is known in the art, there are numerous styles of hats that are worn either for recreational or work purposes. Some examples include but are not limited to visors often worn while playing golf or tennis and the conventional baseball cap which is worn by millions of people for various reasons. Many times people will wear a hat so as to protect their head and face from the sun. Often the hats are worn in temperatures that can be quite warm which can cause an issue for those individuals wearing a hat.

One issue with conventional hats is temperature control. While many hat styles protect a user's face and head from the sun, they can also be hot and uncomfortable to wear. While many hat styles include vent apertures or portions of the hat that are configured to allow air to passthrough, these hats are still hot on a user's head. Some technology has been deployed utilizing air movement devices integrated into the hat but existing technology does not has not provided specific location temperature control as a technique to provide comfort to a wearer of a hat.

Accordingly, it is intended within the scope of the present invention to provide a hat headliner that is configured to provide a temperature dissimilar to that of its surroundings wherein the present invention includes temperature members releasably secured along a perimeter edge of the hat headliner.

SUMMARY OF THE INVENTION

It is the object of the present invention to provide a hat headliner that is configured to provide a temperature dissimilar to that of its environment wherein the hat headliner is secured within numerous styles of hats.

Another object of the present invention is to provide a hat headliner configured to provide temperature control at specific locations of the hat headliner wherein the body of the present invention includes a first material and a second material.

A further object of the present invention is to provide a hat headliner that is configured to provide a temperature dissimilar to that of its environment wherein the first material is adjacent to a wearer's head and is manufactured from a temperature conducting material.

Still another object of the present invention is to provide a hat headliner configured to provide temperature control at specific locations of the hat headliner wherein the second material is manufactured from a temperature reflective material.

An additional object of the present invention is to provide a hat headliner that is configured to provide a temperature dissimilar to that of its environment wherein the hat headliner has a perimeter band member that has the first material on a first side and the second material on a second side.

Yet a further object of the present invention is to provide a hat headliner configured to provide temperature control at specific locations of the hat headliner wherein the perimeter band member includes a plurality of receptacles formed therein circumferentially disposed around the perimeter band member.

Another object of the present invention is to provide a hat headliner that is configured to provide a temperature dissimilar to that of its environment wherein the present invention includes a plurality of temperature members.

Still a further object of the present invention is to provide a hat headliner configured to provide temperature control at specific locations of the hat headliner wherein the temperature members are configured to be inserted into the plurality of receptacles formed in the perimeter band member.

Yet another object of the present invention is to provide a hat headliner that is configured to provide a temperature dissimilar to that of its environment wherein the present invention further includes a storage case for the temperature members.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
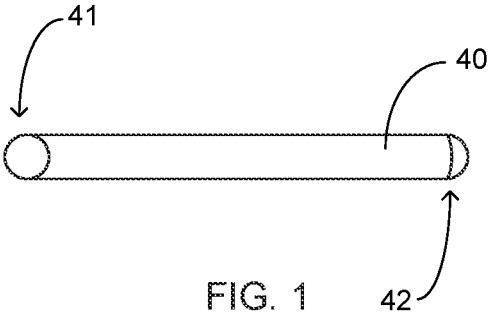
FIG. 1 is a perspective diagrammatic view of a temperature member.
Figure 2:
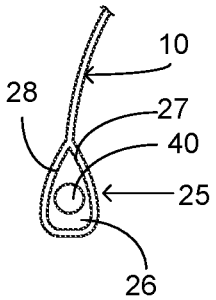
FIG. 2 is a cross-sectional view of a receptacle having a temperature member disposed therein.

Referring now to the drawings submitted herewith, wherein various elements depicted therein are not necessarily drawn to scale and wherein through the views and figures like elements are referenced with identical reference numerals, there is illustrated a hat headliner with temperature control members 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring in particular to Figures herein, the hat headliner with temperature control members 100 includes a body 10 manufactured from a suitable cloth or similar material. The body 10 is secured within the inner cavity 98 of exemplary hat 99 utilizing suitable durable techniques. It is contemplated within the scope of the present invention that the body 10 could be releasably secured to the hat 99 or secured as a permanent portion thereof. The body 10 includes a perimeter band member 15 that is present at the lower edge of the body 10. The perimeter band member 15 is circumferentially disposed around the lower edge 97 of the hat 99.

The perimeter band member 15 has formed therein a plurality of receptacles 25. The receptacles 25 have an interior volume 26 that is configured to receive and store temperature member 40. The receptacles 25 include a first side 27 and a second side 28 wherein the first side 27 is manufactured from a first material and the second side 28 is manufactured from a second material. In a preferred embodiment, the first side 27 is manufactured from a temperature conducting material. By way of example but not limitation, the first side 27 could be manufactured from a carbon-based material. A thermally conductive material for the first side 27 promotes the transfer of the temperature of the temperature member 40 to the location on the wearer's head adjacent to the receptacles 25. In a preferred embodiment of the hat headliner with temperature control members 100, the material for the second side 28 is desired to manufactured from a reflective and/or heat resistant material. In the preferred embodiment of the hat headliner with temperature control members 100 the temperature members 40 are employed to maintain a temperature that is cooler than that of the environmental surroundings. The aforementioned preferred material of the second side 28 is operable to assist in maintaining the temperature of the temperature member 40 so as to provide conductance of the cooler temperature to the wearer of the hat headliner with temperature control members 100. It is contemplated within the scope of the present invention that the second side 28 could be manufactured from various suitable materials.

Referring now to FIG. 1 submitted as a part hereof, a diagrammatic view of the temperature member 40 of the present invention is illustrated therein. The temperature member 40 is elongated and cylindrical in shape having a first end 41 and a second end 42. The temperature member 40 includes an exterior housing 43 wherein the exterior housing 43 is manufactured from a suitable malleable material. The housing 43 is manufactured from a malleable material so as to be inserted into receptacle 25 wherein the housing 43 can then conform to the radius of the receptacle 25 along the perimeter band member 15. The temperature member 40 is sized so as to be mateably inserted into the interior volume 26 of the receptacle 25. The temperature member 40 in a preferred embodiment has within the interior volume thereof a temperature controlling gel or other suitable material that can maintain a temperature that is dissimilar to that of its environment.

In a preferred embodiment of the present invention the temperature member 40 is operable to provide a temperature that is less than that of its surroundings. A gel material within the temperature member 40 further accommodates the ability to place the temperature member 40 at a radius once disposed within the receptacle 25. It should be understood within the scope of the present invention that the temperature member 40 could be provided in any size and/or shape so as to be mateably inserted into the plurality of receptacles 25.

Figure 3:
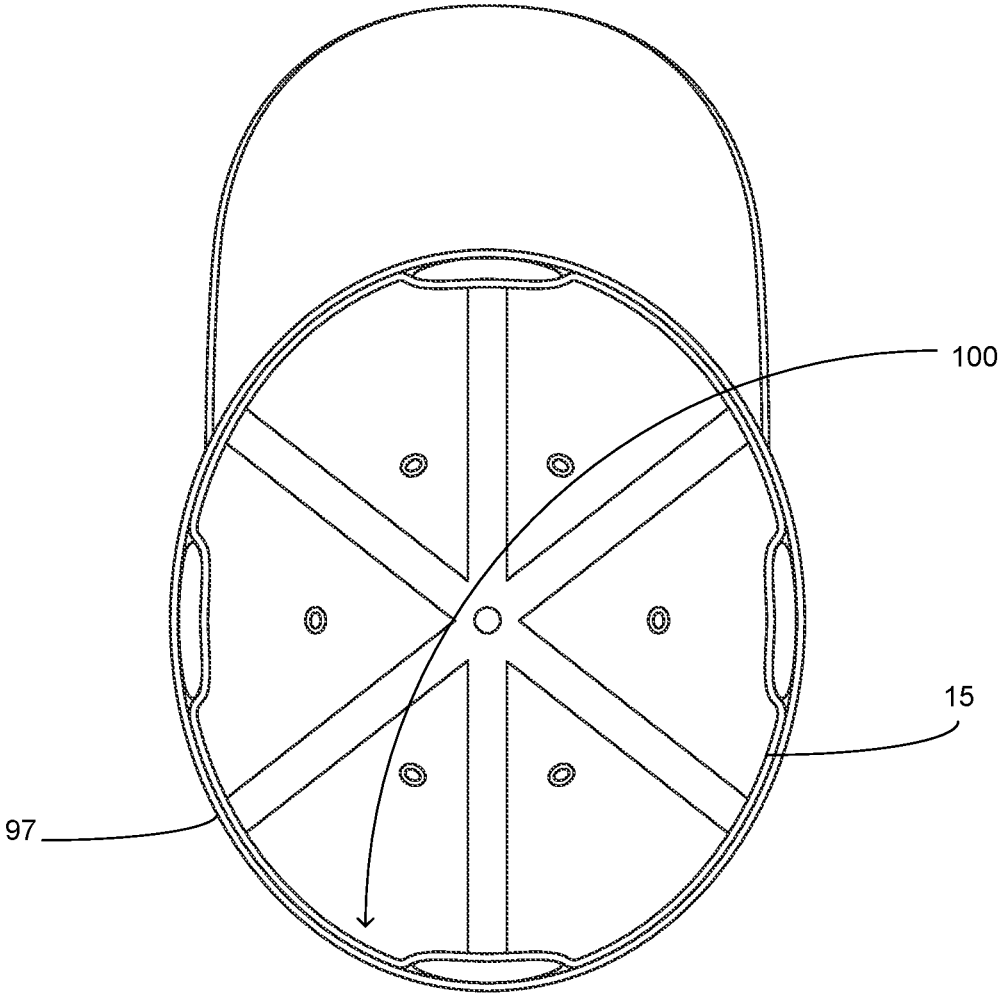
FIG. 3 is a bottom view of an exemplary hat having the headliner of the present invention.

While the illustration in FIG. 3 submitted herewith illustrates four receptacles 25, it should be understood within the scope of the present invention that the hat headliner with temperature control members 100 could have as few as one receptacle 25 or more than four receptacles 25. Furthermore, it is contemplated within the scope of the present invention that the receptacles 25 could be located at various alternate points along the perimeter band member 15. By way of example but not limitation, the hat headliner with temperature control members 100 could place receptacles 25 with temperature members 40 therein adjacent to the temple area of a wearer. Additionally, it is contemplated within a scope of the present invention that the placement of the receptacles 25 be located so as to provide counterbalance of weight thereof so as to inhibit any impact on the wearing of the hat 99.

Figure 4:
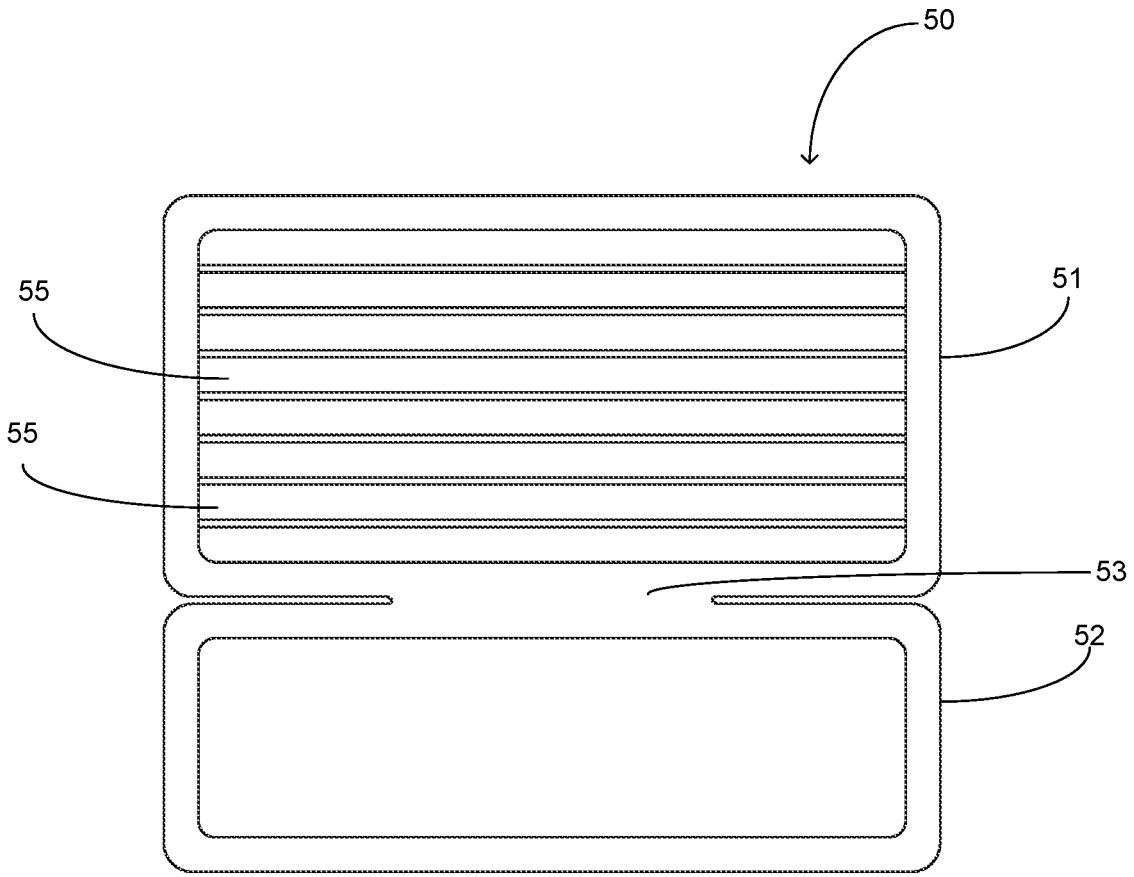
FIG. 4 is a diagrammatic view of an exemplary temperature member case of the present invention.

FIG. 4 illustrates an exemplary storage case 50 of the present invention. The storage case 50 is operable to receive and store a plurality of temperature members 40 in slots 55. The storage case 50 is manufactured having a first half 51 and second half 52 that are hingedly coupled edge 53 so as to be moved between a first position and a second position. The storage case 50 is operable to be placed in a freezer or similar device so as to provide a decrease in the temperature of the temperature members 40 prior to placement within the receptacles 25. It is contemplated within the scope of the present invention that the storage case 50 could be provided in alternate sizes in order to accommodate various quantities of temperature members 40.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A hat headliner configured to provide a temperature to a wearer's head that is dissimilar to that of its environment wherein the hat headliner comprises:

a body, said body being manufactured from a cloth material, said body configured to be secured within a cavity of a hat proximate a lower edge thereof;

a perimeter band member, said perimeter band member being proximate a lower edge of said body, said perimeter band member having a first side and a second side, said perimeter band member being circumferentially disposed around said lower edge of said hat;

at least one receptacle, said at least one receptacle being formed in said perimeter band member, said at least one receptacle having an interior volume, said at least one receptacle being intermediate said first side and said second side;

at least one temperature member, said at least one temperature member being configured to be releasably secured within said interior volume of said at least one receptacle, said at least one temperature member being mateably shaped with the interior volume of said at least one receptacle, said at least one temperature member operable to maintain a temperature dissimilar to that of its environment.

2. The hat headliner configured to provide a temperature to the wearer's head that is dissimilar to that of its environment as recited in claim 1, wherein said at least one temperature member includes an exterior housing, said exterior housing being manufactured from a malleable material, said exterior housing creating an interior volume.

3. The hat headliner configured to provide a temperature to the wearer's head that is dissimilar to that of its environment as recited in claim 2, said interior volume of said exterior housing of said temperature member having a temperature control gel disposed therein.

4. The hat headliner configured to provide a temperature to the wearer's head that is dissimilar to that of its environment as recited in claim 3, wherein said first side of said perimeter band member being manufactured from a first material and said second side of said perimeter band member being manufactured from a second material.

5. The hat headliner configured to provide a temperature to the wearer's head that is dissimilar to that of its environment as recited in claim 4, wherein said first side is manufactured from a thermal conductive material.

6. The hat headliner configured to provide a temperature to the wearer's head that is dissimilar to that of its environment as recited in claim 5, wherein said second side is manufactured from a thermally reflective material.

7. The hat headliner configured to provide a temperature to the wearer's head that is dissimilar to that of its environment as recited in claim 6, wherein said temperature member is elongated and cylindrical in shape having a first end and a second end.

8. The hat headliner configured to provide a temperature to the wearer's head that is dissimilar to that of its environment as recited in claim 7, wherein said exterior housing is positioned to have a radius equal to a radius of a portion of the lower edge of the hat subsequent being disposed within said at least one receptacle.

9. The hat headliner configured to provide a temperature to the wearer's head that is dissimilar to that of its environment as recited in claim 8, wherein said receptacles are placed around the perimeter band member in positions so as to equally counterbalance each other.

10. The hat headliner configured to provide a temperature to the wearer's head that is dissimilar to that of its environment as recited in claim 9, wherein said temperature members are configured to provide a temperature that is cooler than that of its environment.

* * * * *